US006518321B1

(12) United States Patent
O'Rear et al.

(10) Patent No.: US 6,518,321 B1
(45) Date of Patent: Feb. 11, 2003

(54) METHOD FOR TRANSPORTING FISCHER-TROPSCH PRODUCTS

(75) Inventors: Dennis J. O'Rear, Petaluma, CA (US); Mark R. Buetzow, Novato, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 51 days.

(21) Appl. No.: 09/708,068

(22) Filed: Nov. 8, 2000

(51) Int. Cl.[7] ..... C07C 27/00; C07C 7/20; C10G 35/00

(52) U.S. Cl. ..... 518/700; 518/702; 585/899; 208/133

(58) Field of Search ..... 518/700, 702; 585/899; 208/133

(56) References Cited

U.S. PATENT DOCUMENTS

| | | | | |
|---|---|---|---|---|
| 4,965,475 A | | 10/1990 | Kautz | 310/31 |
| 5,276,237 A | | 1/1994 | Mieville | 585/500 |
| 5,292,989 A | | 3/1994 | Davis | 585/751 |
| 5,451,384 A | | 9/1995 | Carr | 423/210 |
| 5,856,260 A | | 1/1999 | Mauldin | 502/325 |
| 5,856,261 A | | 1/1999 | Culross et al. | 502/325 |
| 5,863,856 A | | 1/1999 | Mauldin | 502/325 |
| 5,866,751 A | | 2/1999 | Womack, Jr. et al. | |
| 5,945,459 A | | 8/1999 | Mauldin | 518/715 |
| 5,965,475 A | | 10/1999 | Wittenbrink et al. | 502/66 |
| 5,968,991 A | | 10/1999 | Mauldin | |
| 6,130,260 A | * | 10/2000 | Hall et al. | 518/703 |
| 6,294,076 B1 | * | 9/2001 | Genetti et al. | 208/24 |

FOREIGN PATENT DOCUMENTS

WO WO 01/81503 A2 11/2001

* cited by examiner

*Primary Examiner*—Jafar Parsa
(74) *Attorney, Agent, or Firm*—Burns, Doane, Swecker & Mathis, L.L.P.

(57) ABSTRACT

A transportable Fischer-Tropsch syncrude product and a method for manufacturing and (transporting and/or receiving) the product is disclosed. The product has a true vapor pressure of less than about 15 psia, preferably less than 11 psia, when measured at its transportation temperature, and includes at least 60% by weight, preferably at least 75% by weight, of linear hydrocarbons. The method involves converting a light hydrocarbon feedstock into syngas, converting the syngas to products via Fischer-Tropsch synthesis, and isolating a plurality of transportable products from the Fischer-Tropsch synthesis. The products have true vapor pressures of less than about 15 psia, preferably less than about 11 psia, when measured at their transportation temperature. At least one of the transportable products has a pour point in excess of 20° C. At least two of the products are transported separately in liquid form. The products can be transported using any commonly used means of transportation, including marine tankers, rail cars, pipelines, trucks, barges and combinations thereof. Petroleum products can be blended with one or more of the transportable Fischer-Tropsch products, so long as the resulting blended composition has a true vapor pressure of less than about 15 psia, preferably less than 11 psia, when measured at its transportation temperature.

23 Claims, No Drawings

METHOD FOR TRANSPORTING FISCHER-TROPSCH PRODUCTS

FIELD OF THE INVENTION

This invention is generally in the area of Fischer-Tropsch synthesis and, more particularly, relates to an efficient and safe method for transporting products from Fisher-Tropsch synthesis.

BACKGROUND OF THE INVENTION

Crude oil is a mixture of hydrocarbons when it comes out of the ground. Typically, the mixture is separated into at least three fractions, a gas fraction, an intermediate fraction, and a crude oil fraction, which tend to have some degree of overlap between the fractions. The gas fraction includes mostly $C_{1-3}$ hydrocarbons, the crude oil fraction includes $C_4$+ hydrocarbons, and the intermediate fraction includes mostly $C_{3-5}$ hydrocarbons.

Crude oil is often obtained at a location far from where it is ultimately converted into distillate fuel compositions and other products, and is transported to commercial refineries after the gas and intermediate fractions and, optionally, naphtha fractions, have been removed. Crude oil fractions must have a relatively low vapor pressure when they are transported because of safety regulations as well as practical limits on the pumping and storage of volatile crude oil. However, it is common practice to ship crude oil that includes volatile components in concentrations that do not cause the crude oil to exceed the vapor pressure specification or increase the API gravity excessively.

Petroleum-based crude oil, therefore, typically includes $C_5$+ hydrocarbons, with an amount of butane that will not cause the crude oil to exceed the vapor pressure specification. Propane and lighter hydrocarbons are avoided because of their volatility.

The volatility of crude oil in commercial tankers is typically limited to about 9 psia when measured at the shipping temperature. International maritime regulations limit the maximum Reid Vapor Pressure of crude carried aboard conventional tankers to "below atmospheric pressure" (i.e., less than 14.7 psia). These same regulations limit the closed cup flash point to "not to exceed 60° C." (Safety of Life at Sea (SOLAS) Chapter 22, Regulation 55.1). A practical operational limit is a True Vapor Pressure (not Reid Vapor Pressure) of about 9–10 psia for conventional tankers. A True Vapor Pressure higher than approximately 10 or 11 psia during pumping will make it difficult if not impossible to fully discharge the tanker's cargo tanks, although the actual pumping performance will depend on the particular ship. Receiving shoreside terminals commonly have a maximum True Vapor Pressure limit of 11 psia, based on the maximum capability of floating roof storage tanks.

Waxy crude oils typically do not contain significant quantities of volatile components and can be shipped at temperatures up to around 1 60° F. without exceeding the maximum vapor pressure. Slack waxes from petroleum deoiling and dewaxing operations can also be shipped by tanker in a molten state. These waxes include mostly high molecular weight hydrocarbons and do not typically include significant amounts of volatile light components to cause problems with excessive vapor pressure when the waxes are molten. Accordingly, a preferred method for transporting such waxes is in the molten state.

Like crude oil, natural gas is often located in remote locations. It is often more commercially feasible to convert the natural gas into higher molecular weight hydrocarbons at remote locations than to transport the natural gas to another location for conversion. Many processes, such as Fischer-Tropsch synthesis, can convert methane to higher molecular weight hydrocarbons. Fischer-Tropsch synthesis involves the initial conversion of methane to synthesis gas ("syngas") and the subsequent conversion of syngas to higher molecular weight products. Because it is desirable to limit the amount of processing equipment at remote locations, the Fischer-Tropsch products may be hydroprocessed at commercial refineries far from where the Fischer-Tropsch synthesis is performed.

The products of Fischer-Tropsch synthesis are mostly linear hydrocarbons that often include high melting point wax. A $C_5$+ product stream which is solid at room temperature can be isolated. This product stream is commonly referred to as "syncrude," and can be isolated. In the Mossgas facility in South Africa and Shell's facility in Malaysia (both developed sites with low to moderate capital costs), methane is converted to Fischer Tropsch syncrude which is refined at the site to finished salable products. When capital costs at remote sites are high, the syncrude could also be transported to commercial refineries for hydroprocessing, for example by hydrocracking, hydroisomerization and hydrotreatment, to provide products with desired properties. This minimizes the construction of expensive facilities at remote sites.

Methods for transporting Fischer-Tropsch derived syncrude from a remote site o a commercial refinery are known in the art (See, for example, U.S. Pat. Nos. 5,968,991; 5,945,459; 5,856,261; 5,856,260 and 5,863,856). One approach has been to isolate a $C_{20-36}$ syncrude and ship this composition as a solid. A limitation of this approach is that it is difficult and expensive to transport solids, because it requires expensive forming, loading and unloading facilities.

Other approaches have focused on transporting syncrude, or a syncrude which has been partially refined to convert some of the linear hydrocarbons into iso-paraffin and thus generate a syncrude which is liquid at near ambient temperature. One approach to transporting syncrude in the liquid state involves partially dewaxing the syncrude to form a pumpable liquid (See, for example, U.S. Pat. No. 5,292,989). However, this dewaxing may require the construction of facilities which are expensive and difficult to operate in remote locations.

Another approach involves transporting the syncrude as a molten wax. This transportation method does not require the forming, loading and unloading facilities needed to transport solids, or the dewaxing facilities needed to convert the syncrude into a product that is liquid at room temperature. However, Fischer-Tropsch products include a sufficient quantity of volatile hydrocarbons to cause the products to exceed the vapor pressure specifications if the syncrude were shipped at a temperature at which the syncrude is molten.

It would be advantageous to provide an efficient method for manufacturing and transporting syncrude in the liquid state without requiring dewaxing conditions and without exceeding the vapor pressure specifications of the transportation method. The present invention provides such a method.

SUMMARY OF THE INVENTION

A novel transportable Fischer-Tropsch liquid syncrude product, and a method for manufacturing and (transporting and/or receiving) the product, is disclosed. These products differ from conventional Fischer-Tropsch liquid syncrude products which contain both volatile and waxy components wherein the mixture has a true vapor pressure in excess of 15 psia when measured at the transportation temperature. The transportable products of the invention have true vapor pressure of less than about 15 psia, preferably less than 11 psia, when measured at its transportation temperature.

The method involves converting a light hydrocarbon feedstock into syngas, converting the syngas to products via Fischer-Tropsch synthesis, and isolating a plurality of transportable products from the Fischer-Tropsch synthesis. The products have true vapor pressures of less than about 15 psia, preferably less than about 11 psia, when measured at their transportation temperature. At least one of the transportable products has a pour point in excess of 20° C. At least two of the products are transported separately in liquid form.

The products can be transported using any commonly used means of transportation, including marine tankers, rail cars, pipelines, trucks, barges and combinations thereof. A preferred means of transportation is a marine tanker and, more preferably, each transportable product is either transported in a separate marine tanker or in separate zones within the same tanker. When transported by rail, truck, or barge, each transportable product is preferably transported either in a separate rail, truck or barge, or in separate zones for each transportable product within the same rail, truck or barge.

A $C_{1-2}$ fraction can also be isolated from the Fischer-Tropsch synthesis and recycled upstream of a syngas generation process, flared, used to produce hydrogen, and/or used for fuel. A $C_3$-enriched fraction, including more than 5% by weight $C_3$, preferably more than 20% by weight $C_3$ and most preferably more than 40% by weight $C_3$ can also be obtained. This fraction can be recycled upstream of a syngas generation process, flared, used for fuel, transported in pressurized tankers, and/or transported in refrigerated tankers.

In a preferred process and business method embodiment, petroleum products such as crude oil can be blended with one or more of the transportable Fischer-Tropsch products, so long as the resulting blended composition has a true vapor pressure of less than about 15 psia, preferably less than 11 psia, when measured at its transportation temperature, and where the Fischer-Tropsch product includes at least 60% by weight, preferably at least 75% by weight, of linear hydrocarbons. The resulting composition preferably has a pour point in excess of 20° C. The blending of fractions can occur at any site: the remote Fischer-Tropsch site, a lube manufacturing site, a distillate refinery site, or another location.

DETAILED DESCRIPTION OF THE INVENTION

Preferred embodiments are now described as non-limiting illustrations of the claimed invention. The products in preferred embodiments have true vapor pressure of less than about 15 psia, preferably less than 11 psia, when measured at its transportation temperature, and includes at least 60% by weight, preferably at least 75% by weight, of linear hydrocarbons. At least one product preferably has a pour point in excess of 20° C., more preferably in excess of 40° C., and most preferably in excess of 60° C. It is this higher temperature product or component which has created unsafe transportation conditions unless the isolation of the invention to create the transportable products is used.

The method involves converting a light hydrocarbon feedstock such as natural gas into syngas, converting the syngas to products via Fischer-Tropsch synthesis, and isolating a plurality of transportable products from the Fischer-Tropsch synthesis. The products have true vapor pressures of less than about 15 psia, preferably less than about 11 psia, when measured at their transportation temperature. At least one of the transportable products has a pour point in excess of 20° C., more preferably in excess of 40° C., and most preferably in excess of 60° C. At least two of the products are transported separately in liquid form.

By way of example, the vapor pressure of two commercial low molecular weight waxy foots oils derived from petroleum processing were determined by use of procedures described by Jentoft et al. These oils are typically stored and shipped at 180° F. The first foots oil (142 Foots Oil) was a product from the manufacture of a 140° F. melting point wax. The second (Cut 1A) was a distilled product which is lighter than the lowest melting point wax that is produced in this facility (a 126° F. melting point wax). Thus sample 142 Foots Oil represents a typical mid-range waxy product, and sample 1A represents the lightest and most volatile product expected in current commercial transportation of waxy petroleum oils and waxes. The true vapor pressure results (in psia) for these samples are shown below:

| Temperature of Measurement, ° F. | 142 Foots Oil | Cut 1A |
|---|---|---|
| 100 | 0.00 | 0 |
| 200 | 0.00 | 0.0004 |
| 300 | 0.0004 | 0.0269 |
| 400 | 0.0162 | 0.751 |
| 500 | 0.288 | 10.48 |

Since commercial shipping temperatures for wax never exceed 300° F. (and rarely exceed 200° F.), the maximum true vapor pressure for transportation of molten wax products of this type is at most 0.03 psia. It is not necessary to prepare and ship syncrude blends with this very low true vapor pressure because higher pressures are within acceptable limits and can be used to effectively transport more product, e.g. the more volatile components, in a common compartment. Thus from the standpoint of maximizing the amount of blended product while maintaining acceptable pressures permits the blend to have pressures between 0.03 and 4 psia.

In particularly preferred embodiments, portions of the syncrude blend having pour points of about 80° C. which are shipped at temperatures greater than 20° C., e.g. shipped at 100° C., will have true vapor pressures of less than 3.8 psia to minimize cargo loss and enhance safety. Of course, selecting blends with even lower vapor pressures further enhance safety and minimize cargo loss. Ideally selecting the lowest possible shipping temperature, and pressures less than 1 psia for blends with pour points in excess of 20° C. is most desirable.

The following definitions will be helpful in understanding the compositions and methods described herein.

Linear hydrocarbon: The class of compounds including linear paraffins, linear olefins (internal and alpha), linear alcohols, and linear acids. Members of this class of compounds above $C_{20}$, either singly or in mixtures, are typically solid or waxy at ambient temperature (20° C.). Liquid linear hydrocarbons can be analyzed by gas chromatography. The concentration of linear hydrocarbons which are solids at room temperature can be determined by a solvent dewaxing method. An acceptable method involves the following: A 300-g portion of sample is dissolved in 1200 ml of 1:1 toluene-MEK solvent. Heating may be necessary to achieve complete dissolution. The solution is then cooled overnight at −15 to −20° F. to crystallize the wax. The wax crystals formed are filtered and recovered. The filtrate is vacuum distilled to separate the toluene-MEK solvent from the dewaxed oil. Occluded solvent in the wax is removed by heating the wax on a hot plate with nitrogen blowing on the surface. The weights of the recovered oil and wax are divided by the original sample weight to obtain the percent oil and wax.

Transportation temperature: For materials that are fluid at ambient temperature (20° C.) or below, the transportation temperature is 20° C. For materials that are solid at typical ambient temperature, the transportation temperature is 5° C. above the pour point, preferably 10° C. above the pour point, and most preferably 20° C. above the pour point as measured by ASTM D-97.

Remote site: A remote site is a location away from a refinery or market and which may have a higher cost of construction than the cost of construction at the refinery or market. In quantitative terms, the distance between the remote site and the refinery or market (the distance of transportation) is at least 100 miles, preferably more than 500 miles, and most preferably more than 1000 miles.

Transporting in liquid form: This means that at least a portion of the product is liquid, while the remainder can be solid. The portion that is liquid is at least 10%, preferably more than 25%, and most preferably more than 50%. It is within the scope of the methods described herein that waxy products will be completely liquid, or at least a pumpable slurry, upon initial loading in a transportation vessel and upon unloading the vessel, but at least a portion may become solid during transportation as the product cools. This solid can easily be melted at the receiving end, for example, using steam heaters. However, it is most preferable that the compositions are pumpable when loaded and unloaded, and that the product does not become completely solid during transportation.

Separately transported: This means at least two components are transported in separate apparatus or in same apparatus with internal partitions. The apparatus can include marine tanker, rail car, pipeline, trucks, barge, and the like. Thus this may involve shipping at least two components in separate marine tankers, separate rail cars, separate pipelines, separate trucks or separate barges. It might also involve shipping the two components by different apparatus. It might also involve shipping in the marine tankers, rail cars, pipelines, trucks, or barges but with partitions to keep the components physically separate.

Light hydrocarbon feedstock: These feedstocks can include methane, ethane, propane, butane and mixtures thereof. In addition, carbon dioxide, carbon monoxide, ethylene, propylene and butenes may be present.

Syncrude: A mixture derived from a Fischer-Tropsch process that does not meet all specifications for a finished salable product such as jet fuel, diesel fuel, lube base stock, fully refined wax, gasoline and the like without further processing. Various transportable syncrude compositions are described in more detail below.

Transportation method: The transportation method can vary, but preferably involves using a closed vessel with no significant exposure to air during transportation. At the temperature at which the compositions are transported, the pressure inside the vessel should not exceed about 14.9 psia.

True Vapor Pressure: A pressure expressed in psia at a defined temperature, e.g. the transportation temperature. This pressure can be measured by a number of techniques, the choice of which depends on the properties of the fraction, such as it's boiling range. The suitable methods include ASTM D2889; ASTM D5482; ASTM D323; ASTM D6377-99; ASTM E1194-87; the *Engineering* Data Book, Vol.1, Sections 1–16 by the Gas Processors Suppliers Association, 1994; Jentoft, R. E., Carlstrom, A. A., and Gouw, T. H., Analytical Chemistry, "Rapid Determination of the Vapor Pressure of Lubricating Oils and Hydraulic Fluids," 40, 1014 (1968); and the like. The true vapor pressure can also be calculated from a D2887 distillation by conversion of the weight distribution into mole percent, assuming a uniform UOPK factor for all fractions, estimation of Antoine constants, and use of Raoult's Law. The calculated pressures should be calibrated with measured values that are in excess of 1 psia. The preferred method for measuring the true vapor pressure for samples that have pour points in excess of 20° C. is the method of Jentoft et al.

Marine Tanker: A ship used for transporting hydrocarbons, typically but not limited to crude oil and refined products.

Paraffin: A hydrocarbon with the formula $C_nH_{2n+2}$.

Olefin, A hydrocarbon with at least one carbon-carbon double bond.

Oxygenate: A hydrocarbonaceous compound that includes at least one oxygen atom.

Distillate fuel: A material containing hydrocarbons with boiling points between about 60 and 1100° F. The term "distillate" means that typical fuels of this type can be generated from vapor overhead streams from distilling petroleum crude. In contrast, residual fuels cannot be generated from vapor overhead streams by distilling petroleum crude, and are then a non-vaporizable remaining portion. Within the broad category of distillate fuels are specific fuels that include: naphtha, jet fuel, diesel fuel, kerosene, aviation gas, fuel oil, and blends thereof.

Gasoline: A material suitable for use in spark-ignition internal-combustion engines for automobiles and light trucks (motor gasoline) and in piston engine aircraft (aviation gasoline) meeting the current version of at least one of the following specifications:

ASTM D4814 for motor gasoline

European Standard EN 228 for motor gasoline

Japanese Standard JIS K2202 for motor gasoline

ASTM D910 for aviation gasoline

ASTM D6227 "Standard Specification for Grade 82 Unleaded Aviation Gasoline".

UK Ministry of Defence Standard 91–90/Issue 1 (DERD 2485), GASOLINE, AVIATION: GRADES 80/87, 100/130 and 100/130 LOW LEAD Diesel fuel: A material suitable for use in diesel engines and conforming to the current version of at least one of the following specifications:

ASTM D 975- "Standard Specification for Diesel Fuel Oils"

European Grade CEN 90

Japanese Fuel Standards JIS K 2204

The United States National Conference on Weights and Measures (NCWM) 1997 guidelines for premium diesel fuel The United States Engine Manufacturers Association recommended guideline for premium diesel fuel (FQP-1A)

Jet fuel: A material suitable for use in turbine engines for aircraft or other uses meeting the current version of at least one of the following specifications:

ASTM D1655

DEF STAN 91-91/3 (DERD 2494), TURBINE FUEL, AVIATION, KEROSINE TYPE, JET A-1, NATO CODE: F-35

International Air Transportation Association (IATA) "Guidance Material for Aviation Turbine Fuels Specifications", 4th edition, March 2000

United States Military Jet fuel specifications MIL-DTL-5624 (for JP-4 and JP-5) and MIL DTL-83133 (for JP-8).

Lube base oil and lube base stock: Materials meeting the current version of the definition in API 1509.

Fully refined wax: Fully refined wax meets FDA food grade requirements as defined in Title 21 of the Code of Federal Regulations, Sections 178.3710 and 172.886. Fully refined waxes have very low odor (ASTM D1833), oil content less than 0.5% (ASTM D721), and a Saybolt color of +25 to +30 (ASTM D156).

Natural gas is an example of a light hydrocarbon feedstock. In addition to methane, natural gas includes some heavier hydrocarbons (mostly $C_{2-5}$ paraffins) and other impurities, e.g., mercaptans and other sulfur-containing compounds, carbon dioxide, nitrogen, helium, water and non-hydrocarbon acid gases. Natural gas fields also typically contain a significant amount of $C_5$+ material, which is liquid at ambient conditions.

The methane, and optionally ethane and/or other hydrocarbons, can be isolated and used to generate syngas. Various other impurities can be readily separated. Inert impurities such as nitrogen and helium can be tolerated. The methane in the natural gas can be isolated, for example in a demethanizer, and then de-sulfurized and sent to a syngas generator. The $C_2$+ products can then be separated, for example in a deethanizer, to provide ethane and a $C_3$+ product stream. Propane, n-butane and isobutane can be isolated, for example in a turbo-expander, with the propane and butanes separated using a depropanizer.

Methane (and/or ethane and heavier hydrocarbons) can be sent through a conventional syngas generator to provide synthesis gas. Typically, synthesis gas contains hydrogen and carbon monoxide, and may include minor amounts of carbon dioxide, water, unconverted light hydrocarbon feedstock and various other impurities. The presence of sulfur, nitrogen, halogen, selenium, phosphorus and arsenic contaminants in the syngas is undesirable. For this reason, it is preferred to remove sulfur and other contaminants from the feed before performing the Fischer-Tropsch chemistry or other hydrocarbon synthesis. Means for removing these contaminants are well known to those of skill in the art. For example, ZnO guardbeds are preferred for removing sulfur impurities. Means for removing other contaminants are well known to those of skill in the art.

The Fischer-Tropsch reaction may be effected in a fixed bed, in a slurry bed, or in a fluidized bed reactor. The Fischer-Tropsch reaction conditions may include using a reaction temperature of between 190° C. and 340° C., with the actual reaction temperature being largely determined by the reactor configuration. Thus, when a fluidized bed reactor is used, the reaction temperature is preferably between 300° C. and 340° C.; when a fixed bed reactor is used, the reaction temperature is preferably between 200° C. and 250° C.; and when a slurry bed reactor is used, the reaction temperature is preferably between 190° C. and 270° C.

An inlet synthesis gas pressure to the Fischer-Tropsch reactor of between 1 and 50 bar, preferably between 15 and 50 bar, may be used. The synthesis gas may have a $_2$:CO molar ratio, in the fresh feed, of 1.5:1 to 2.5:1, preferably 1.8:1 to 2.2:1. The synthesis gas typically includes 0.1 wppm of sulfur or less. A gas recycle may optionally be employed to the reaction stage, and the ratio of the gas recycle rate to the fresh synthesis gas feed rate, on a molar basis, may then be between 1:1 and 3:1, preferably between 1.5:1 and 2.5:1. A space velocity, in $m^3$ (kg catalyst)$^{-1}$ hour$^{-1}$, of from 1 to 20, preferably from 8 to 12, may be used in the reaction stage.

In principle, an iron-based, a cobalt-based or an iron/cobalt-based Fischer-Tropsch catalyst can be used in the Fischer-Tropsch reaction stage. The iron-based Fischer-Tropsch catalyst may include iron and/or iron oxides which have been precipitated or fused. However, iron and/or iron oxides which have been sintered, cemented, or impregnated onto a suitable support can also be used. The iron should be reduced to metallic Fe before the Fischer-Tropsch synthesis. The iron-based catalyst may contain various levels of promoters, the role of which may be to alter one or more of the activity, the stability, and the selectivity of the final catalyst.

Preferred promoters are those influencing the surface area of the reduced iron ("structural promoters"), and these include oxides or metals of Mn, Ti, Mg, Cr, Ca, Si, Al, or Cu or combinations thereof.

The products from Fischer-Tropsch reactions performed in slurry bed reactors generally include a gaseous reaction product and a liquid reaction product. The gaseous reaction product includes hydrocarbons boiling below about 650° F. (e.g., tail gases through middle distillates). The liquid reaction product includes hydrocarbons boiling above about 650° F. (e.g., vacuum gas oil through heavy paraffins). The products from Fischer-Tropsch reactions performed in high temperature Fischer-Tropsch reactors are generally gaseous products that can form a liquid product when a portion of the gaseous product condenses.

The minus 650° F. product can be separated into a tail gas fraction and a condensate fraction, i.e., about $C_5$ to $C_{20}$ normal paraffins and higher boiling hydrocarbons, using, for example, a high pressure and/or lower temperature vapor-liquid separator or low pressure separators or a combination of separators. The fraction boiling above about 650° F. (the wax fraction) primarily contains $C_{20}$ to $C_{50}$ linear paraffins with relatively small amounts of higher boiling branched paraffins.

If a $C_5$+ fraction is isolated from a Fischer-Tropsch synthesis performed under conditions which favor formation of wax and heavy products, rather than methane and light ($C_{3-8}$) products, the fraction is likely to be solid at room temperature. In the methods described herein, the $C_5$+ fraction is transported in molten form. However, at the temperature at which the products are molten, lighter hydrocarbons (roughly between about $C_5$ and $C_{14-20}$) are volatile. If the light and heavy hydrocarbons are transported together in a sealed container in the molten state, the resulting pressure would exceeding the specifications for most methods of transportation. This problem is overcome by removing volatile hydrocarbons that would raise the pressure above 15 psia, more preferably above 11 psia, at the transportation temperature.

A $C_{1-2}$ fraction can also be isolated and recycled upstream of a syngas generation process, flared, used to produce hydrogen and/or used for fuel. A $C_3$-enriched fraction, including more than 5% by weight $C_3$, preferably more than 20% by weight $C_3$ and most preferably more than 40% by weight $C_3$, can also be obtained. This fraction can be recycled upstream of a syngas generation process, flared, used for fuel, transported in pressurized tankers, and/or transported in refrigerated tankers.

An LPG fraction can also be isolated. The LPG fractions preferably include mostly $C_{3-5}$ hydrocarbons, and preferably include mostly propane, n-butane and iso-butane. They may also contain small amounts of pentanes and, less preferably, $C_{3-5}$ olefins. In a preferred embodiment, the LPG is a primary propane-rich and/or iso-butane-rich product stream as such streams are known in the art. It is suitable for all possible end uses, for example, as an alternative fuel source for automobiles. Most preferably, the composition falls within the stringent specifications for LPG product streams in the area of alternative fuels. The LPG fraction may include an appreciable amount of olefins and/or oxygenates, which may be hydrotreated to form paraffins. In a preferred LPG product, the amount of ethane is less than about five percent by volume of the mixture, propylene is less than about one percent by volume of propane, and butylene is less than about one percent by volume of iso-butane. $C_5$+ hydrocarbons are preferably less than about twenty five percent by volume of the mixture. The sulfur content is preferably less than about 150 ppm.

The LPG fraction can be transported at a temperature at which the volatility does not exceed commercial specifications (i.e., less than about 15 psia, preferably less than about 11 psia). LPG generally has a pressure of about 120 psia at ambient temperatures, so it must be cooled when shipped to meet these specifications unless it is shipped under pressure in commercial transportation means which do not have these specifications.

In one embodiment, individual propane and butane streams are isolated, rather than LPG. This can be accomplished, for example, by passing a mixture including $C_{1-4}$ hydrocarbons through a demethanizer, deethanizer and a depropanizer.

When the gaseous reaction product from the Fischer-Tropsch synthesis step is being cooled and various fractions collected, the first fractions collected tend to have higher average molecular weights than subsequent fractions. A $C_{14-20}$ fraction can be obtained, and combined with the liquid reaction products to form a $C_{14}$+ syncrude, by isolating the fraction while the gaseous reaction products are being cooled. A $C_{14-20}$ fraction can also be obtained by distilling the $C_{5-13}$ hydrocarbons from the $C_{14}$+ products after the middle distillate fraction is collected. However isolated, the $C_{14-20}$ fraction can be combined with the condensate fraction to yield a transportable syncrude composition which includes at least 60% by weight, preferably at least 75% by weight, of linear hydrocarbons and which is solid at room temperature.

The vapor pressure of the composition can be measured at the transportation temperature using techniques well known to those in the art. If the vapor pressure of the composition exceeds specifications at the transportation temperature, lower boiling hydrocarbons can be removed from the composition, for example via vacuum distillation or other suitable means known to those of skill in the art.

In addition to the syncrude and optionally an LPG fraction, a $C_5$ to $C_{14-20}$ fraction can also be obtained and shipped at a temperature at which the volatility does not exceed commercial specifications (i.e., less than about 15 psia, preferably less than about 11 psia). The $C_5$ to $C_{14-20}$ fraction can be transported at or around ambient temperature, although generally, temperatures in excess of 200° C., more preferably 100° C., should be avoided. If the material is liquid or at least a pumpable slurry at or around ambient temperature, temperatures around ambient temperature are preferred.

The fractions described above can optionally be combined with hydrocarbons from other streams, although such hydrocarbons should not elevate the pressure of the composition above about 14.7 psia at the transportation temperature. For example, an LPG can be supplemented with LPG obtained from a natural gas field. A $C_5$ to $C_{14-20}$ fraction can be combined with a similar fraction obtained from the fractional distillation of crude oil. The syncrude can be combined with waxy crude oils, crude oils and/or slack waxes from petroleum deoiling and dewaxing operations.

At least two separate liquid products are isolated from the Fischer-Tropsch synthesis and transported. At least one of the products is a syncrude product. The products can be transported using any commonly used means of transportation, including marine tankers, rail cars, pipelines, trucks, barges and combinations thereof. A preferred means of transportation is a marine tanker and, more preferably, each transportable product is either transported in a separate marine tanker or in separate zones within the same tanker. When transported by rail, truck, or barge, each transportable product is preferably transported either in a separate rail, truck or barge, or in separate zones for each transportable product within the same rail, truck or barge. Each zone within a means of transportation or each separate means of transportation should have the ability to control the temperature such that each product can meet the desired pressure specifications. Accordingly, the means of transportation should be able to cool any LPG fractions that are transported (or, alternatively, be able to safely handle elevated pressures), maintain any $C_5$ to $C_{14-20}$ fractions at or around room temperature, and maintain the syncrude product at a temperature at which it is molten, at least while the product is being pumped into or out of the transportation means, which temperature is generally at least 5° C. above the pour point, preferably 10° C. above the pour point, in any event, no more than 250° C., more preferably less than 200° C., and most preferably less than 150° C.

Those skilled in the art will recognize or be able to ascertain using no more than routine experimentation many equivalents to the specific embodiments of the invention described herein. Such equivalents are intended to be encompassed by the following claims.

What is claimed is:

1. A process for manufacturing transportable Fischer-Tropsch-syncrude products, comprising:

a) converting a light hydrocarbon feedstock into syngas;

b) converting at least a portion of the syngas to products via Fischer-Tropsch synthesis;

c) recovering a plurality of transportable products from the Fischer-Tropsch synthesis wherein the true vapor pressures of at least two of the transportable products are less than about 15 psia, when measured at their transportation temperature, wherein at least one of said two transportable products has a pour point in excess of 20° C.; and d) transporting at least two of the transportable products separately in liquid form, wherein the products comprise greater than 60% by weight of linear hydrocarbons.

2. The process of claim 1, wherein the products comprise greater than 75% by weight of linear hydrocarbons.

3. The process of claim 1 wherein the true vapor pressures of each of the transportable products is less than about 11 psia when measured at their transportation temperature, preferably 0.03 to 4 psia.

4. A process according to claim 1 wherein transportation is selected from the group consisting of marine tanker, rail car, pipeline, trucks, barge, or combinations thereof.

5. A process according to claim 4 wherein each transportable product is separately transported.

6. The process according to claim 1 further comprising recovering a $C_{1-2}$ fraction.

7. The process according to claim 6, further comprising one or more of the following steps:

recycling the $C_{1-2}$ fraction upstream of a syngas generation process, flaring the $C_{1-2}$ fraction, using the $C_{1-2}$ fraction to produce hydrogen, using the $C_{1-2}$ fraction for fuel, and combinations thereof.

8. The process according to claim 1 further comprising recovering a $C_3$-enriched fraction comprising more than 5% $C_3$ by weight.

9. The process of claim 8 wherein the $C_3$-enriched fraction comprises more than 20% $C_3$ by weight.

10. The process of claim 9 wherein the $C_3$-enriched fraction comprises more than 40% $C_3$ by weight.

11. The process of claim 8 further comprising one or more of the following steps:

recycling the $C_3$-enriched fraction upstream of a syngas generation process, flaring the $C_3$-enriched fraction, using the $C_3$-enriched fraction for fuel, transporting the $C_3$-enriched fraction in pressurized tankers, transporting the $C_3$-enriched fraction in refrigerated tankers and combinations thereof.

12. The process according to claim 1 wherein the transportable Fischer-Tropsch liquid syncrude product has a true vapor pressure greater than molten wax but less than about 15 psia when measured at its transportation temperature and wherein the product has a pour point in excess of 40° C.

13. The process according to claim 12 wherein the product has greater than 75% linear hydrocarbons by weight, wherein the true vapor pressure of the product is less than 11 psia when measured at its transportation temperature.

14. The process according to claim 12 further including a material selected from the group consisting of crude petroleum, petroleum fractions, products derived from petroleum, and mixtures thereof.

15. A transportable Fischer-Tropsch liquid syncrude product wherein the true vapor pressure of the product is greater than molten finished wax but less than about 15 psia when measured at its transportation temperature and wherein the product has a pour point in excess of 40° C.

16. The product of claim 15 comprising greater than 75% linear hydrocarbons by weight, wherein the true vapor pressure of the product is less than 11 psia when measured at its transportation temperature.

17. The product according to claim 15 further including a material selected from the group consisting of crude petroleum, petroleum fractions, products derived from petroleum, and mixtures thereof.

18. A process for manufacturing a finished salable product including at least one first site and at least one second site, remote from each other, wherein one or a plurality of said first sites form a tansportable Fischer-Tropsch liquid syncrude product used at said second site(s), said second sites forming said finished salable product, the process comprising:

a) receiving at the second site the transportable Fischer-Tropsch liquid syncrude product having a true vapor pressure greater than molten finished wax but less than 15 psia when measured at its transportation temperature and a pour point in excess of 40° C., which is made by a method comprising:

i) converting a light hydrocarbon feed to syngas, ii) subjecting the syngas to Fischer-Tropsch synthesis to form a predominantly linear hydrocarbon product, and iii) isolating a transportable Fischer-Tropsch liquid syncrude product from the product of the Fischer-Tropsch syntheisis, and b) converting the transportable Fischer-Tropsch liquid syncrude product to a finished salable product.

19. The process according to claim 18 wherein the Fischer-Tropsch syncrude product further includes a material selected from the group consisting of crude petroleum, petroleum fractions, products derived from petroleum, and mixtures thereof.

20. The process according to claim 18 wherein the Fischer-Tropsch syncrude product contains greater than 75% linear hydrocarbons by weight, and has a true vapor pressure of less than 11 psia when measured at its transportation temperature.

21. Process according to claim 13 wherein the true vapor pressure of the product is 0.03 to 4 psia when measured at its transportation temperature.

22. The process according to claim 16 wherein the true vapor pressure of the product is 0.03 to 4 psia when measured at its transportation temperature.

23. The process according to claim 20 wherein the true vapor pressure of the product is 0.03 to 4 psia when measured at its transportation temperature.

* * * * *